US006101634A

United States Patent [19]

Martinez

[11] Patent Number: 6,101,634

[45] Date of Patent: Aug. 15, 2000

[54] TRANSPORTABLE GARMENT FOR USE WITH NON AMBULATORY PATIENTS

[76] Inventor: Dolores D. Martinez, 2925 SG Francis #4, Portland, Oreg. 97202

[21] Appl. No.: 09/421,398

[22] Filed: Oct. 21, 1999

[51] Int. Cl.[7] ..... A61G 15/00

[52] U.S. Cl. ..... 2/238; 2/69; 2/300; 128/845; 128/873

[58] Field of Search ..... 2/69, 238, 83, 2/80, 102, 114, 78.1, 400, 402, 338, 109, 227, 300, 310, 326, 327; 128/845, 846, 873, 876, 875

[56] References Cited

U.S. PATENT DOCUMENTS

| | | | |
|---|---|---|---|
| 1,310,958 | 7/1919 | O'Conner | 128/875 |
| 1,329,119 | 1/1920 | George | 2/238 |
| 1,675,234 | 6/1928 | Tarlton | 2/238 |
| 3,701,395 | 10/1972 | Theobald | 128/876 |
| 4,028,742 | 6/1977 | Marquis | 2/300 |
| 4,258,440 | 3/1981 | McGowan | 2/238 |
| 4,396,013 | 8/1983 | Hasslinger | 128/133 |
| 4,860,560 | 8/1989 | Lundelius | 128/846 |
| 5,361,418 | 11/1994 | Luzenske | 2/338 |
| 5,647,378 | 7/1997 | Farnum | 128/876 |
| 5,836,310 | 11/1998 | Winters et al. | 2/102 |
| 5,896,859 | 4/1999 | Carroll | 128/845 |

*Primary Examiner*—Amy B. Vanatta
*Attorney, Agent, or Firm*—John P. Halvonik

[57] ABSTRACT

A garment for wearing by non ambulatory patients is shown and described as having at least two pair of handholds near the top seam of the garment for transport of such patients. The garment is made of front and rear portions connected to one another by a reinforced crotch portion. A pair of rear straps extend from the rear section of the garment and extend upward so that they may be crossed upon the back and the front of the patient and then joined to the front section of the garment.

1 Claim, 3 Drawing Sheets

TRANSPORTABLE GARMENT FOR USE WITH NON AMBULATORY PATIENTS

FIELD AND BACKGROUND OF THE INVENTION

The invention relates to the field of garments and in particular to a hospital-type of garment designed to be worn by those patients who need help in moving about and as such the garment is designed to allow hospital personnel to help lift and transport the patient by means of handles and such on the sides of the garment.

It is believed that patients who are paraplegics, quadriplegics and others sort of non ambulatory patients will benefit greatly by a garment that can be worn by them and will allow them to be safely transported by use of handles on the sides of the garment. While it is believed that the device will find its greatest use in hospital settings it is also possible that it can be used to transport patients from accident sites, especially where the patient may be in a remote area and the patient needs to be lifted out of say a valley or a gorge.

Such a garment is thought to be useful inasmuch as both those who are unable to move on their own and those hospital personnel who are in charge of moving such patients will be have a means to facilitate movement that is both safe for the patient and easy for the hospital worker. For the patient, the idea of a garment that holds them in while they are being closely is believed to alleviate fears they may have of being dropped and such during transport.

The device is also thought to be useful to caregivers who suffer from backstrain and the like due to the burdens of lifting patients that are placed upon them. By making adequate use of the handholds provided by this invention, such caregivers can be in a better position to lift and transport such patients and so reduce the number of injuries resulting from such transport. The use of straps going across the front and rear of the patient provides for additional means for the care givers to place their hands and so stabilize patients. This may be of additional use in cases where the patient does not have control of his/her upper body. In such cases, the use of the straps allows for three or more people to take part in the transport operation.

DESCRIPTION OF THE PRIOR ART

While there are garments with handles that are used for wearing by motorcycle riders, there are no known garments that are designed for use in hospital type of settings. In fact there are no known garments with the particular construction of the applicant's invention.

SUMMARY OF THE INVENTION

A garment for wearing by non ambulatory patients including paraplegics, quadriplegics and the like. The garment has two pairs of hand holds in the front and the rear of the garment in order to allow hospital personnel to transport the patient by use of the hand holds. The garment is made of front and rear portions connected to one another by a reinforced crotch portion. A pair of rear straps extend from the rear section of the garment and extend upward so that they may be crossed upon the back and the front of the patient and then joined to the front section of the garment. A belt is connected to the top portions of the garment and has a means for adjusting it in length and the securing the ends to one another.

It is an object of the invention to provide a garment for wearing by patients that cannot move about on their own in order to facilitate the transport of such patients by hospital personnel.

Another object of the invention is to provide hospital garment for wearing by those who are unable to walk or move and having handles on the garment that will allow the patient to be picked up and transported by hospital personnel using the handles on the garment.

Another object of the invention to proved a means to transport non ambulatory patients by means of a garment that will be easy to wear and will result in a safe and efficient transport of the patients upon using the handles on the garment.

Another object of the invention to proved a garment for the transport of non ambulatory patients that is made of sturdy construction and is inexpensive to manufacture.

Other objectives of the invention will become apparent to those skilled in the art once the invention has been shown and described.

DESCRIPTION OF THE PREFERRED EMBODIMENT

Figure 1:
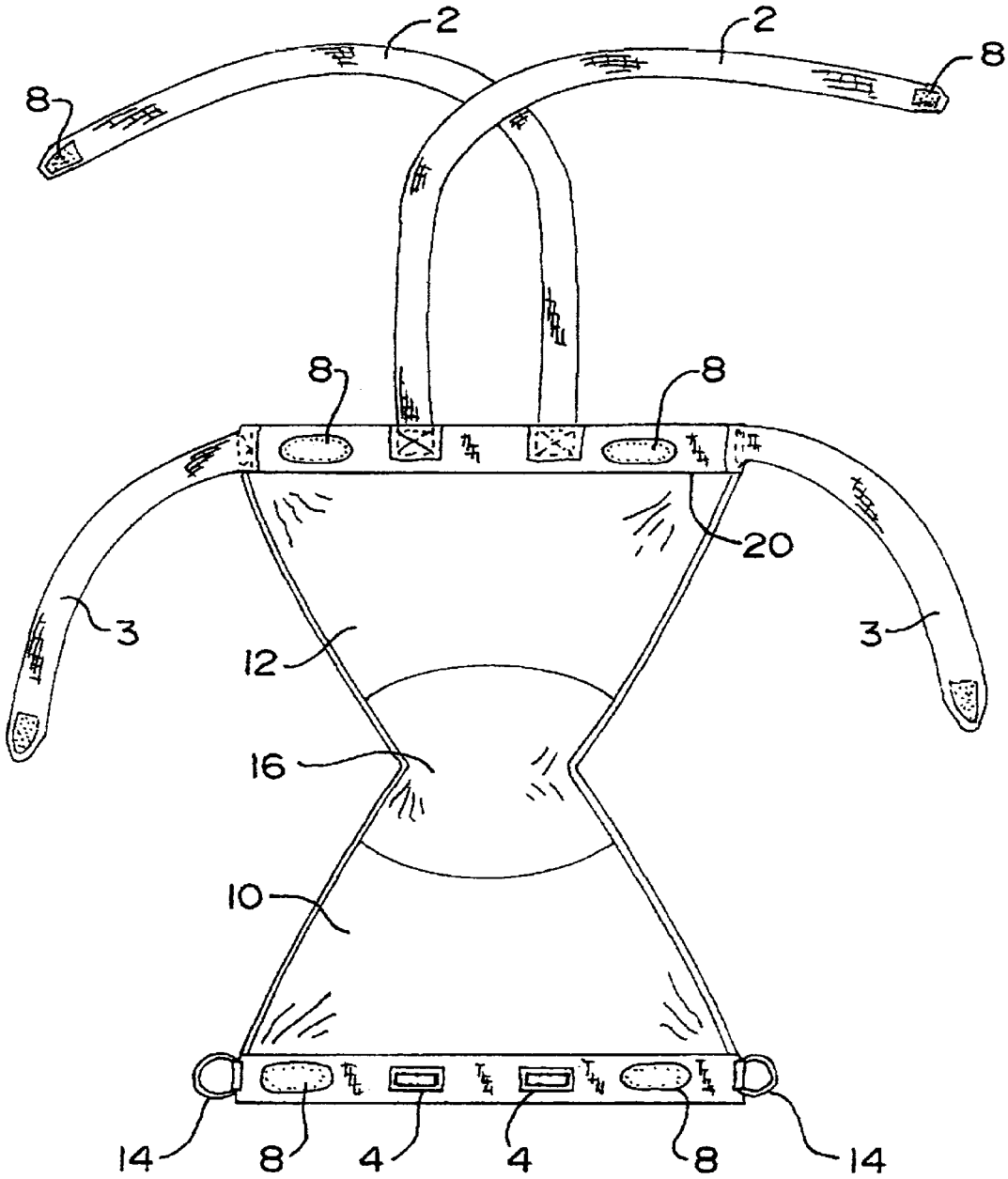
FIG. 1 depicts overall construction of the invention

The overall construction of the garment is as shown in FIG. 1 Preferably the garment will be constructed of two pieces that are sewn together so as to form a panty, see FIG. 1. One half of the panty will be the front portion 10 and the other half, the rear portion 12. It is preferred that the back portion of the panty be of slight larger size than the front portion to accommodate the typical shape of the human body in these areas. It is also preferred that the panty or garment should be of rather loose fitting construction so that it can be worn over the patient's clothing.

A reinforced crotch section 16 is preferably used to connect both sections to one another. Such section may be of heavier material than the rest of the garment and should have reinforced stitching or a similar construction in order to allow this section of the garment to bear the full weight of the patient.

Torso straps 2 are sewn or otherwise connected to the rear portion. It is also possible to connect the torso straps to the front portion without changing the design in any appreciable manner. The straps extend upward from the belt portion 3 of the garment and are crossed upon the user's back and then looped over the shoulder. They are then crossed over the front of the user and are attached by buckles 4 or similar attachment means at the front of the garment.

There should be corresponding buckles 4 on the ends of each strap. The corresponding buckles should be of a sort that will compliment those on the front (4) and so these buckles will be attachable to one another and secure enough that they can hold the weight of the person. The straps can be detachable in the rear of the garment as well and in this case, a similar set of buckles and/or clasps, etc. can be used to make these ends of the straps detachable from the rear of the garment.

Hand hold portions 8 exist in both the front and the rear of the garment. Preferably there would be two handles in the front and two in the rear of the garment and they are likely to be in connection with the belt section of the garment. Such handle portions should be of an opening of sufficient size to permit a hand of the hospital personnel to gain a handhold on the garment.

Two such hand holds are provided and this will allow both hands of one person to grip one side of the garment. The use of handholds on both the front and rear of the garment thus permits two people to hold onto the garment and so transport the non ambulatory patient. Such handles may be created as apertures in the doubled seam 20 that exists on both the front and the rear of the belt. It is believed that such a construction will insure that the hand holds are sufficiently sturdy enough to allow for carrying the person in the garments by means of the handholds.

In addition to carrying the person, such a garment may simply allow the caregivers to walk alongside the patient and ambulate the patient by use of the handholds. In otherwords to support the patient without necessarily having to carry him/her.

These straps are distinguished from the belt 3 that itself may be considered a strap also. The belt is made in connection with either the front or rear of the garment and may connected by means of a seam 20 that is sewn into the front or rear portion of the garment. Rings 14 on the front of the garment may be used to join the two ends of the belt upon the front of the garment and so keep the belt in place. The rings are preferably doubled rings, that is there are two such rings at each side of the garment so that each end of the belt can be looped first over one ring and then the other and so made secure by tightening it upon the rings. Such construction is appropriate as it will allow for adjustment of the length of the belt and is easy to take off and put on.

Other means such as buckles or clasps, etc. may be used on the front of the garment in order to join the belt and/or otherwise keep it connected to itself. The garment itself would preferably be made of sturdy material such as canvas, denim, nylon, polyester, and other strong cloth. The garment can be made of many different colors and it can be produced in appropriate sizes, such as small medium and large.

Figure 2:
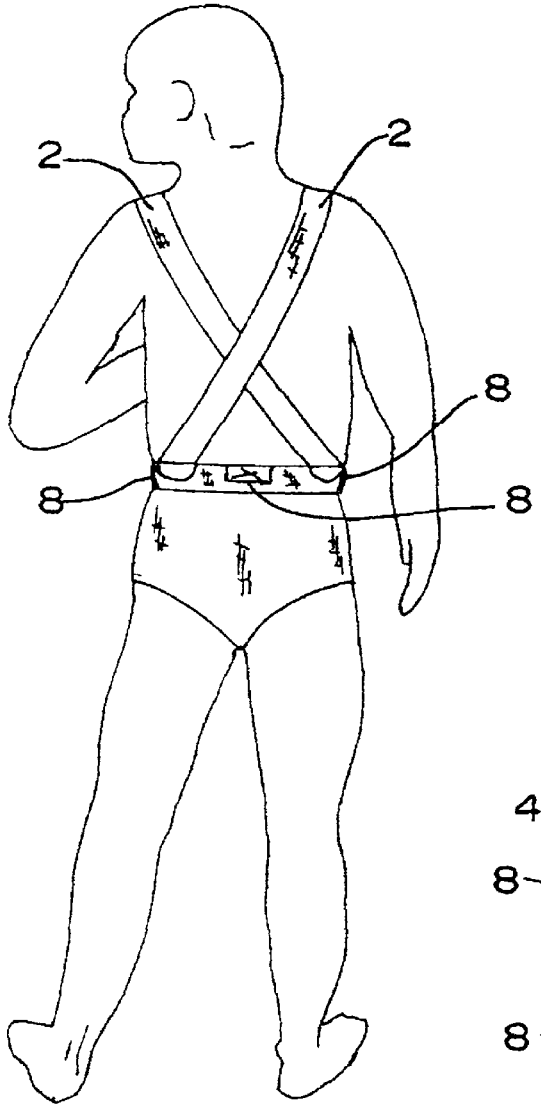
FIG. 2 rear view of apparatus on a person.
Figure 3:
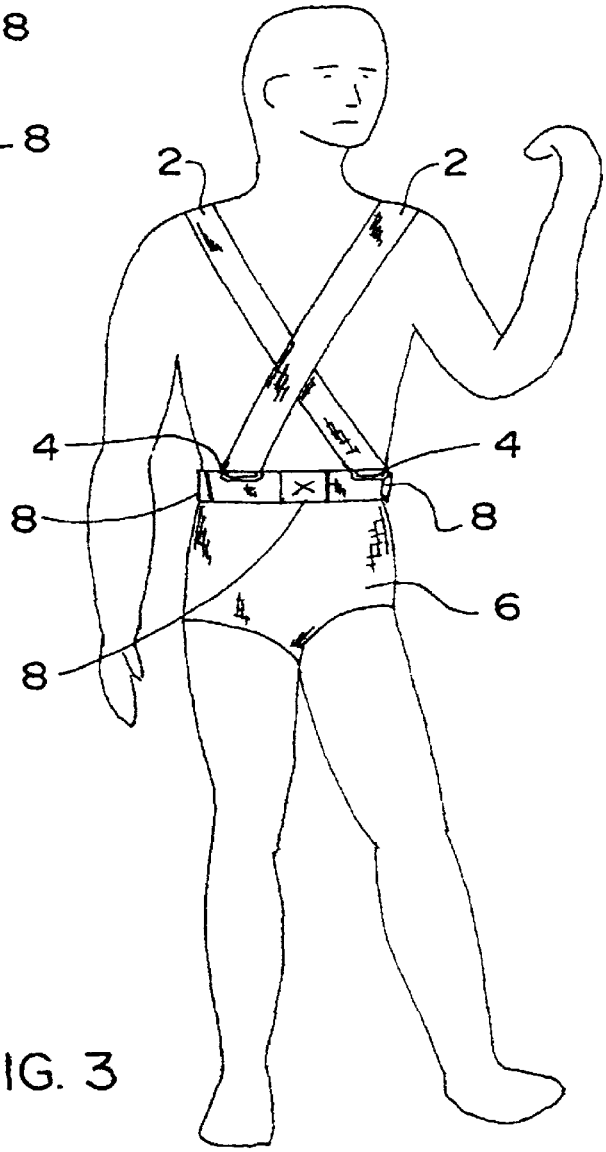
FIG. 3 front view of apparatus on a person.
Figure 4:
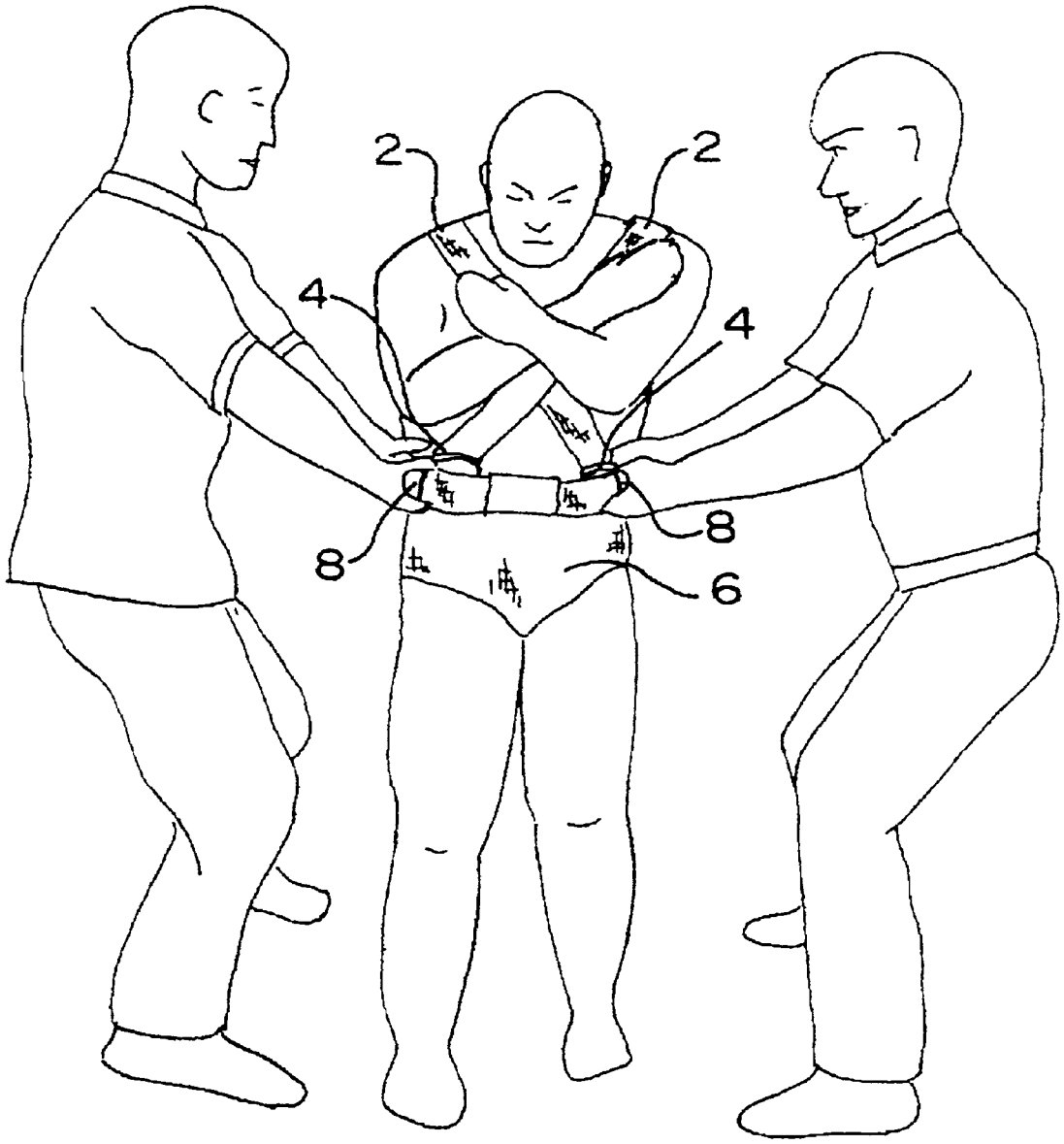
FIG. 4 apparatus in use to transport a patient.

FIGS. 2 and 3 depict the device as it will be worn upon the patient. The straps that cross over the rear of the patient offer additional hand holds for a third and/or fourth person to take art in the lifting operation. FIG. 4 shows use of the device with two people doing the lifting in this case.

I claim:

1. A garment of two sections for transport of patients comprising: a front half portion made of sturdy material and connected to a rear half portion by a reinforced crotch section; a top seam in connection with both said front and rear portions, said top seam of folded construction so as to produce a reinforced section having a passageway for a belt, a belt in connection with said seam and having two ends and a means to connect said ends to one another, said garment having at least two apertures in said seam portion of said rear section and a second pair of apertures in said seam portion of said front section, said apertures of size sufficient to permit in the ingress of a human hand; said rear portion having a pair of torso straps in connection with said rear portion, said torso straps each having one end in connection with said rear portion and another end that is free, said free end having a means to connect said torso straps to said front portion of said garment, said torso straps of length sufficient to be crossed over the back of the patient, looped over the front shoulders of the patient and then crossed over the front of the patient.

* * * * *